United States Patent [19]

Reale et al.

[11] 4,442,896

[45] Apr. 17, 1984

[54] TREATMENT OF UNDERGROUND BEDS

[76] Inventors: Lucio V. Reale, 1371 Lake Ontario Dr., SE., Lake Bonavista, Clagary, Calberta, Canada; William R. McKay, 2700 Carlton St., SW., Calgary, Alberta, Canada

[21] Appl. No.: 400,323

[22] Filed: Jul. 21, 1982

[51] Int. Cl.[3] ..... E21B 43/04; E21C 25/54

[52] U.S. Cl. ..... 166/278; 299/35; 166/50

[58] Field of Search ..... 166/278; 299/15, 10, 299/35, 4; 175/61

[56] References Cited

U.S. PATENT DOCUMENTS

| | | | |
|---|---|---|---|
| 2,796,129 | 6/1957 | Brandon | 166/278 X |
| 4,003,440 | 1/1977 | Cherrington | 175/61 |
| 4,214,374 | 7/1980 | Miotti | 405/267 X |

FOREIGN PATENT DOCUMENTS

| | | | |
|---|---|---|---|
| 199389 | 3/1951 | Belgium | 299/35 |
| 391900 | 9/1908 | France | 299/35 |
| 1427064 | of 1966 | France | 299/35 |

*Primary Examiner*—Stephen J. Novosad
*Assistant Examiner*—Michael Starinsky
*Attorney, Agent, or Firm*—Townsend and Townsend

[57] ABSTRACT

A method of preparing an underground bed for treatment. A channel is formed in the bed extending from the ground down through the bed and up to the ground. A cutting device is inserted into the channel operated to form a pathway in a substantially vertical plane.

9 Claims, 5 Drawing Figures

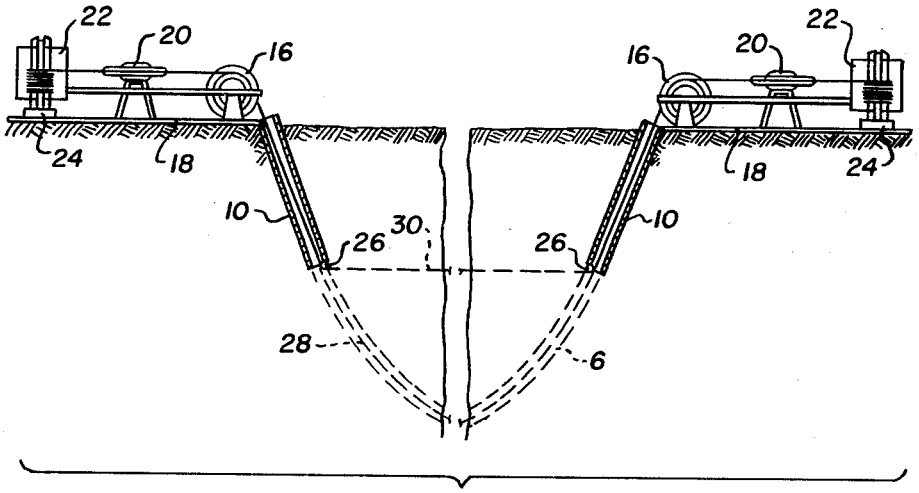
Fig. 3.
Fig. 4.
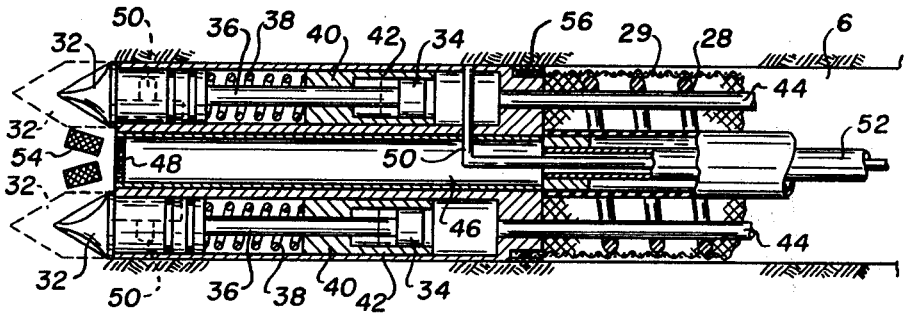
Fig. 5.
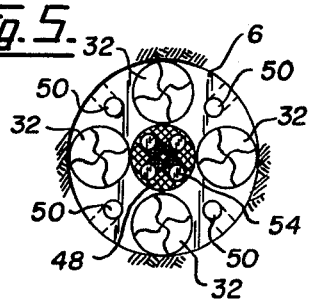

TREATMENT OF UNDERGROUND BEDS

FIELD OF THE INVENTION

This invention relates to the treatment of underground beds for, for example, the extraction of oil or the gasification of coal.

BACKGROUND OF THE INVENTION

The gasification of coal in underground formations is well known. Similarly the extraction of oil by the use of solvents from beds previously considered exhausted, at least to conventional techniques, is now well known. It has been estimated that by normal well drilling operations in a fresh field less than 30% of the deposits can be obtained. Using such methods as injecting water and solvents it has been estimated that another 30 to 35% can be extracted. It appears to be generally agreed that at least 35% of the original material in the oil bed, before the well was drilled, cannot be extracted economically. Although systems have been proposed for extracting and remaining oil these systems are complicated and expensive.

Brandon, in U.S. Pat. No. 2,796,129 seeks to extract oil from an apparently exhausted well by undercutting the formation and by forming horizontal tunnels from which the undercutting can be carried out. The notion in Brandon is to release the capillary lock within the strata causing an outflow of oil, water and gas. However, the formation of a horizontal cut in this matter can be quite complicated and the Brandon method has not found wide application. In particular for each cut three access points are required.

Malloy, in U.S. Pat. No. 3,452,545 shows a method of earth working that is of interest. In Malloy an endless chain is carried by standards and winches. However, Malloy is a means of cutting down into the ground from the surface, that is in a direction different from that required by the art to which the present invention relates.

The present invention seeks to provide a method of preparing an underground bed for treatment by forming easily and relatively cheaply large numbers of substantially vertical fissures in that underground formation to facilitate in particular the saturation of the formation with a solvent. However, it is also applicable to the gasification of coal, to the steam extraction of an oil formation and to the use of combustion and high pressure water injection as a means of forcing the oil out of an apparently exhausted formation.

SUMMARY OF THE INVENTION

Accordingly, in a first aspect the present invention is a method of preparing an underground bed for treatment that comprises forming a channel in the bed extending from the ground at a first point, down through the bed to a predetermined depth and up to the ground at a second point; inserting a cutting device into the channel and operating the cutting device to form a pathway in a substantially vertical plane.

In a further aspect the invention provides an apparatus useful in the formation of an underground channel. That apparatus comprises a body, cutting means at a leading edge of the body; means to operate the cutting means; means to locate the body in a channel it has cut and to seal off the cut channel from the leading edge of the body; and means to feed a liquid supply to flush cut pieces back to the surface.

BRIEF DESCRIPTION OF THE DRAWINGS

Aspects of the invention are illustrated, merely by way of example, in the accompanying drawings in which:

FIG. 3 is a section showing the cutting of channels according to the present invention;

FIG. 4 indicates an apparatus according to a further aspect of the present invention; and FIG. 5 is a front view of the apparatus of FIG. 4.

DESCRIPTION OF THE PREFERRED EMBODIMENTS

Figure 1:
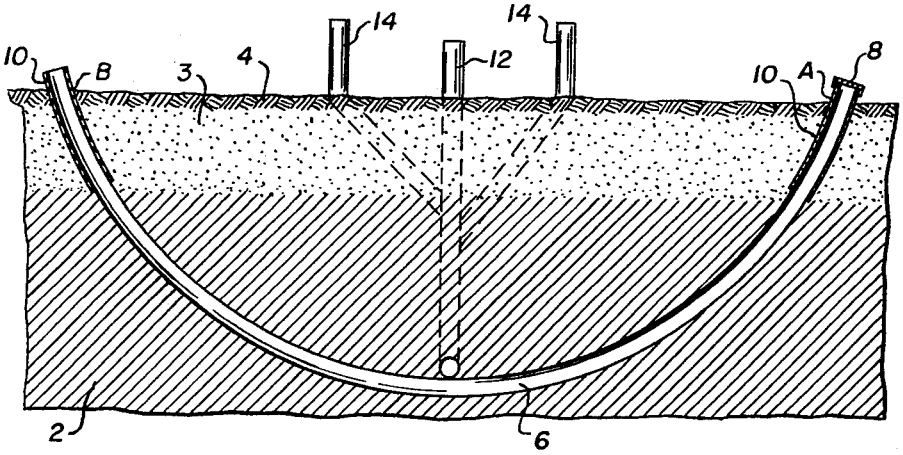
FIG. 1 is a section through a bed prior to treating it by the process of the present invention.

FIG. 1 illustrates an underground bed 2 having an overlying stratum 3 to the ground level 4. FIG. 1 illustrates a channel 6 useful in the invention although, of course, the members used to cut the other channels, or fissures, into the bed 2 are not shown. A cap 8 is shown at one end of the channel 6 as are pipe inserts 10 at each end of the channel 6. There are also shown extractor channels comprising a central channel 12 and branch channels 14.

FIG. 3 illustrates the cutting of fissures according to the present invention. FIG. 3 illustrates the channel 6 of FIG. 1 and the upper tubes 10. It also shows the presence of a cutting means introduced, for example, by the apparatus shown in FIGS. 4 and 5 described later. FIG. 3 shows at each end of the channel a spring drum 16 positioned on a platform 18. There is a reciprocating piston motor 20 and a rotating drum 22 driven by a motor 24. Wheels or sheaves 26 are also shown positioned within each end tube 10.

Figure 2:
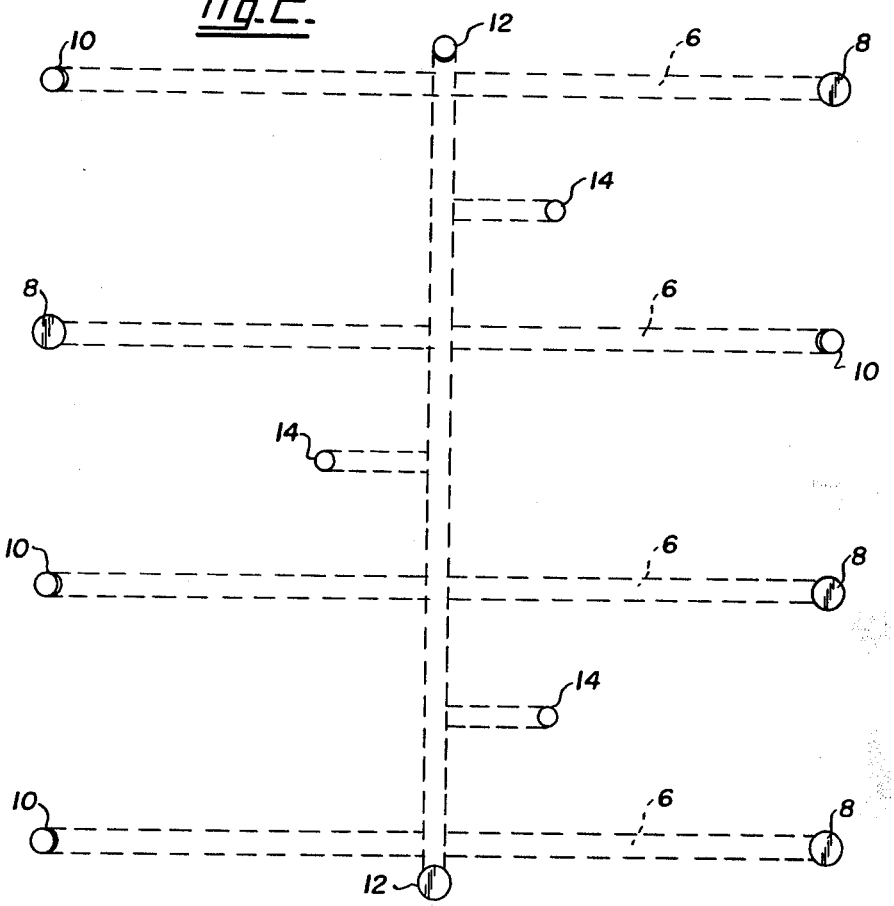
FIG. 2 is a plan view of the bed of FIG. 1.

To form a fissure according to the present invention a channel 10 shown in FIG. 1 is formed by, for example, conventional means well known in the art. Alternatively, the apparatus of FIGS. 4 and 5 may be used. As the channel 6 is formed a cutting wire 28 is trailed behind the device or otherwise attached so that it follows the cutting device on its generally parabolic path. For example the channel 6 may start at point A in FIG. 1 and finish at point B, that is the cutting apparatus moves from point A to point B trailing the cutting wire 28 behind it. A casing 29 may also be inserted in channel 6, for example by being pulled behind the device—see FIG. 4 as an example of a casing 29. Once the channel is formed the wire 28 is detached and the arrangement shown in FIG. 3 brought into effect. That is the wire is fed over spring drum 16 attached to motor 20 and the drum 22. The wire 28 is then reciprocated back and forth in the channel 6 by motor 10 and it cuts a fissure vertically upwardly first through casing 29 and through the formation to the final position shown by a broken line 30 in FIG. 3. As the wire moves upwardly the slack is taken up on drums 22. As particularly illustrated in FIG. 2 any number of channels, and thus fissures, can be formed. The channels and fissures can criss cross and cut the bed into quite small areas between fissures. As will be appreciated the formation of large numbers of fissures and channels in the bed exposes a larger area to the action of recovery agents and thus greatly facilitates the extraction of any oil in the bed.

Once the fissures have been formed the technique is relatively conventional. One end of the channel 12 and one end of each of the channels 6 is capped and the other end is injected with solvent or whatever other means of extraction is to be used. The mixture of oil and solvent or oil and extracting medium is then extracted through branch pipes 14.

As an alternative the ends of neighbouring channels 6 may be joined to each other in such a way that, apart from the end channels 6, each channel 6 communicates with one neighbour at one of its ends and with the other neighbour at the other end. Each end channels 6 communicate with its only neighbour at one end while the other end is left open. One open end forms an inlet, the other an outlet, for extracting medium.

If casing 29 is of mesh, as shown, then the extracting medium can more easily permeate the bed. A porous casing, is thus preferred although, of course, the cutting wire will form an opening in casing 29, whether it is mesh or continuous, and solvent can pass through that opening.

If a casing 29 is present tubes 10 will normally be inserted within the casing 29 in channel 6.

FIGS. 4 and 5 illustrate an apparatus useful in the process of the present invention. However, it should be emphasized in this regard that the process of the present invention may be practised with channels 6 formed in any way and, indeed, can be practised in a bed in which channels have already been formed, by a previous operator, to use prior art extraction techniques. That is the existing channels can have unwanted casing removed, and can have a cutting wire 28 or the like inserted into them and the arrangement shown in FIG. 3 then attached to move the cutting wire 28 upwardly through the bed 2.

It should also be commented that although a cutting wire 28 is needed to operate in materials that are hard such as coal deposit and oil shale, with other materials such as tar sands or the like, which are soft, a mere heated wire or perforated pipes may be sufficient to form the channels. Other materials may be inserted after the original cutting wire device is removed from the fissure, such as perforated metal pipes—or micro-wave wires, or devices related with controlled atomic fusion energy. Furthermore, the channels, which may display a tendency to collapse, can be filled with a porous material, as is known in the art, to preserve the structure prior to the extraction steps. Mesh casing 29 may also be used, as indicated.

The apparatus of FIGS. 4 and 5 comprises chisel cutting heads 32 attached to pistons 34 through connecting rod 36. A spring 38 is positioned between the head of the chisel 32 and an abutment 40 within the apparatus. Pistons 34 are located in cylinders 42. A supply of compressed air is fed to the pistons through pipes 44 extending to the surface.

Debris produced in the cutting process is washed back through the apparatus through a central passage 46 having a filter member 48 at its inlet. Water is conveniently used as a washing medium and is fed to the exterior of the device through a pipe 50 and back to the surface through pipe 52 which surrounds pipe 50. A grinding mechanism 54 to grind down relatively large pieces of debris is provided and may be driven by, for example, hydraulic motors (not shown).

The drive to each chisel 32 is independent of the drives of the other chisels 32 so that by driving the chisels 32 in a particular manner a course can be steered through a formation.

To use the device illustrated in FIGS. 3 and 4 a small starting channel may be formed and the pistons 34 then actuated by connecting them to a supply of compressed air. The pistons are driven forward by the compressed air, which is intermittent, in conventional manner. As the air supply stops extremely briefly the springs 38 force the piston back. In this way the chisels 32 are reciprocated. Cutting wire 28 and mesh casing 29 are attached to the rear of the device so that they are trailed through the channel 6 as the channel 6 is cut. By controlling the speed of the chisels 32 relative to each other the device can be made to follow a predetermined course. When the channel 6 has been cut it has been found desirable to insert end casings 10 into the starting and end points of the channel, within mesh 29 if the mesh is present. These end casings 10 receive the rollers 26 which define an upper level for the cut made by the cutting wire 28.

The present invention provides a device that is simple yet effective and can be successful in extracting large amounts of oil previously unextractable. The method and apparatus of the invention is also useful in the gasification of coal where a contact between the coal and the gasifying medium can be greatly improved compared with prior systems.

An underground fire can also be started at specific locations within a set of drilled channels connecting a vertical fissure. This provides the required heat to obtain an enhanced oil recovery or chemical reaction needed for the coal gasification process.

I claim:

1. A method of preparing an underground bed for treatment that comprises:

forming a channel in the bed with a drill having an attached drill string and detachably securing a cutting device to the drill string, such that said cutting device is inserted while forming the channel, the channel extending from the ground at a first point, down through the bed to a predetermined depth and up to the ground at a second point;

operating the cutting device to form a pathway in a substantially vertical plane.

2. A method as claimed in claim 1 in which the cutting device is a wire able to be reciprocated to cut through the bed.

3. A method as claimed in claim 1 including filling the channel as it is formed to avoid collapse of the bed.

4. A method as claimed in claim 3 in which a porous material is used to fill the channel.

5. A method as claimed in claim 4 in which the porous material is sand or gravel.

6. A method as claimed in claim 1 in which a plurality of channels are formed in the bed.

7. A method as claimed in claim 6 in which at least some of the channels intersect.

8. A method as claimed in claim 1 comprising positioning a casing in the end of the channel after its formation.

9. A method as claimed in claim 8 in which each casing is equipped with rollers to assist the motion of the cutting wire.

* * * * *